United States Patent [19]

Jurgens

[11] 4,011,918

[45] Mar. 15, 1977

[54] STABILIZER FOR DRILL STRINGS

[75] Inventor: Rainer Jürgens, Celle, Germany

[73] Assignee: Christensen, Inc., Salt Lake City, Utah

[22] Filed: Jan. 21, 1976

[21] Appl. No.: 650,897

[52] U.S. Cl. ..... 175/325; 285/333; 285/328; 285/381; 308/4 A

[51] Int. Cl.[2] ..... E21B 17/10; E21C 9/00

[58] Field of Search ..... 175/323, 325; 285/328, 285/333, 334, 355, 390, 381; 308/4 A

[56] References Cited

UNITED STATES PATENTS

| | | | |
|---|---|---|---|
| 1,450,845 | 4/1923 | Flournoy, Jr. | 285/355 X |
| 2,646,253 | 7/1953 | Johnston | 175/325 X |
| 3,747,700 | 7/1973 | Rilling | 175/323 |
| 3,923,324 | 12/1975 | Cruickshank et al. | 285/333 |
| 3,942,824 | 3/1976 | Sable | 285/333 X |
| 3,945,446 | 3/1976 | Ostertag et al. | 175/325 |

*Primary Examiner*—Ernest R. Purser
*Assistant Examiner*—Richard E. Favreau
*Attorney, Agent, or Firm*—Subkow & Kriegel

[57] ABSTRACT

Stabilizer apparatus for a rotary drill string, or other running string, including a body structure forming part of the rotary drill string and a stabilizer positioned on an end portion of the body structure, the stabilizer comprising a stabilizer sleeve having a conical interior surface shrink-fitted onto a mating external conical surface of the body structure by fluid pressure actuated or hydraulic means, permitting a safe, strong interconnection between the stabilizer and the drill string body structure. The stabilizer can be readily removed when necessary and replaced with another stabilizer similarly shrink-fitted onto the drill string body structure. The lower end of the stabilizer is internally upset and is received in an annular groove in the body structure, or under the lower end of the body structure, providing a large contact area between the stabilizer and a device threaded on the body structure which engages the lower end of the stabilizer.

16 Claims, 3 Drawing Figures

STABILIZER FOR DRILL STRINGS

Figure 1:
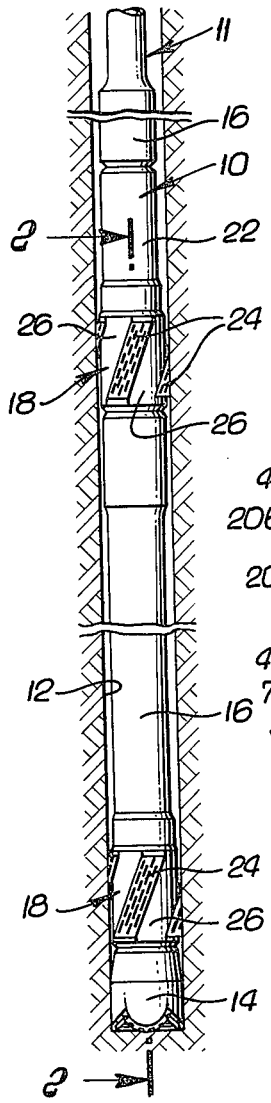

The present invention relates to rotary bore hole drilling devices, and more particularly to a stabilizer mounted on a drill string body structure to provide a strong and functionally integral connection between the body structure and stabilizer, while insuring ready release of the stabilizer from the body structure when replacement of the stabilizer becomes necessary.

In the United States patent application of Alfred Ostertag and Claus Marx, Ser. No. 430,077, filed Jan. 2, 1974, now U.S. Pat. No. 3,945,446, a stabilizer sleeve is disclosed which is rigidly secured on and to a companion rotary drill string member, such as a drill collar, by a shrink-fit frictional attachment of the stabilizer sleeve against the periphery of the drill string member. As specifically disclosed in the above application, the inner surface of the sleeve has a slightly tapered or conical surface caused to grip a companion external conical surface on the drill string member. This result is achieved by expanding the sleeve hydraulically while it is being forced in one direction longitudinally along the external surface of the drill string member to the required extent, whereupon the hydraulic pressure is relieved, which permits the sleeve to contract and effect a very strong friction grip between the external and internal surfaces of the drill string member and sleeve. Removal of the sleeve is accomplished by hydraulically expanding the sleeve and shifting it longitudinally of the drill string member in the reverse direction.

Stabilizer sleeves have been shrink-fitted to drill string members at one or more locations along the drill string, and also closely adjacent a drill bit attached to the lower end of the drill string. As disclosed in the above patent application and patent, the drill bit is threaded into a lower drill string box until the bit shoulders against the end of the box. This causes plastic deformation of the lower end portion of the box. With boxes of sufficient thickness at the shoulders, the extent of plastic deformation is small and negligible, creating no difficulties in effecting subsequent removal of the stabilizer sleeve from the drill collar, nor in replacing the stabilizer on the drill collar. However, on some shouldered connections, the extent of plastic deformation is not negligible, leading to diametral interference between the stabilizer sleeve and drill string member at their lower portions. This interference renders the dismounting of the sleeve from the drill string member difficult, and in some cases results in damage to the parts. The stabilizer sleeve has elastic strain only and no corresponding plastic strain, which results in interference between the parts. Difficulty is also encountered in remounting a stabilizer sleeve on the drill collar member.

Similar difficulties may occur in securing a stabilizer sleeve to a drill string member at a desired location along the drill string remote from the drill bit. Plastic deformation can still occur on the end of a stabilizer sleeve, causing deformation between the sleeve and the drill string member on which it is mounted, and leading to difficulties in disassembling the sleeve from the drill string member and the remounting of the sleeve on the drill string member.

The above difficulties are overcome by providing a larger area of contact between the end of the stabilizer sleeve and the device which is threaded on the drill string member without decreasing the outside diameter of the sleeve. This larger contact area is achieved by providing the stabilizer sleeve with an internal upset at its lower end, which is contacted by the device threaded on the drill string member, such internal upset extending under the drill string member or into an annular groove in the drill string member. Upon threading the device on the drill string member and tightening it against the stabilizer sleeve, the greater contact area between the device and the sleeve minimizes the plastic deformation of the parts to such an extent that it is negligible. Accordingly, deformation of or binding between the parts cannot prevent ready disassembly or assembly of the sleeve from or on the drill string member.

Additionally, the internally upset sleeve portion is provided with internal relief, which results in clearance between such portion and the adjacent drill string member, resulting in the prevention of abnormal plastic deformation on the parts. In the case of threading a drill bit in a drill string member or drill collar, the bit is caused to shoulder against the stabilizer sleeve on the drill collar, thereby precluding the make-up torque from effecting plastic deformation of the drill collar, which, particularly in a collar box of insufficient thickness at its end, would have been deformed sufficiently to produce diametral interference between the sleeve and lower end of the collar.

This invention possesses many other advantages, and has other objects which may be made more clearly apparent from a consideration of several forms in which it may be embodied. Such forms are shown in the drawings accompanying and forming part of the present specification. These forms will not be described in detail for the purpose of illustrating the general principles of the invention; but it is to be understood that such detailed description is not to be taken in a limiting sense.

Figure 2A:
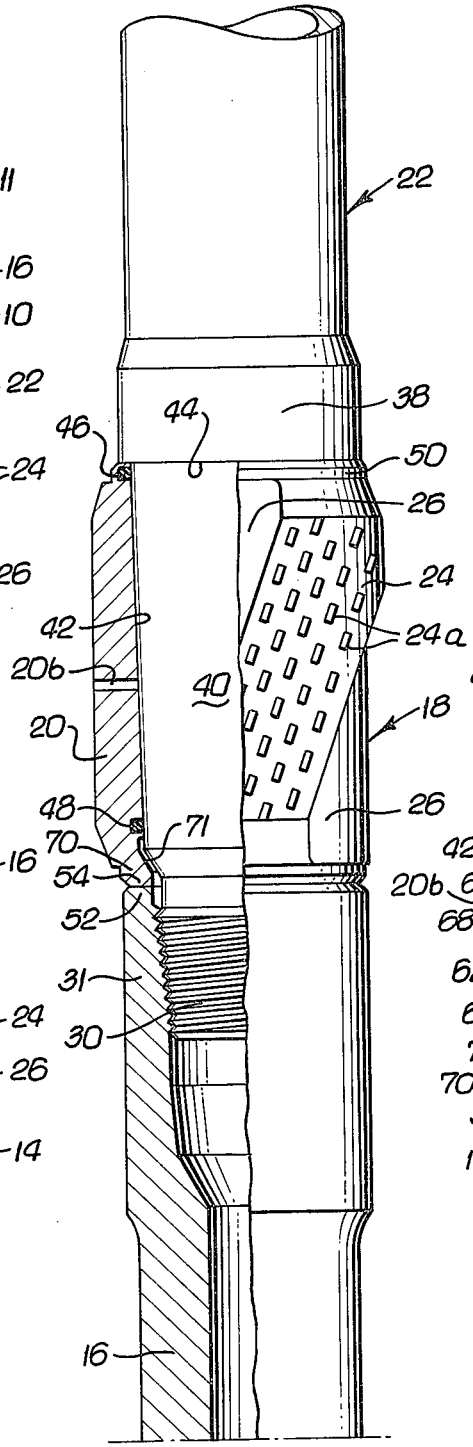
Figure 2B:
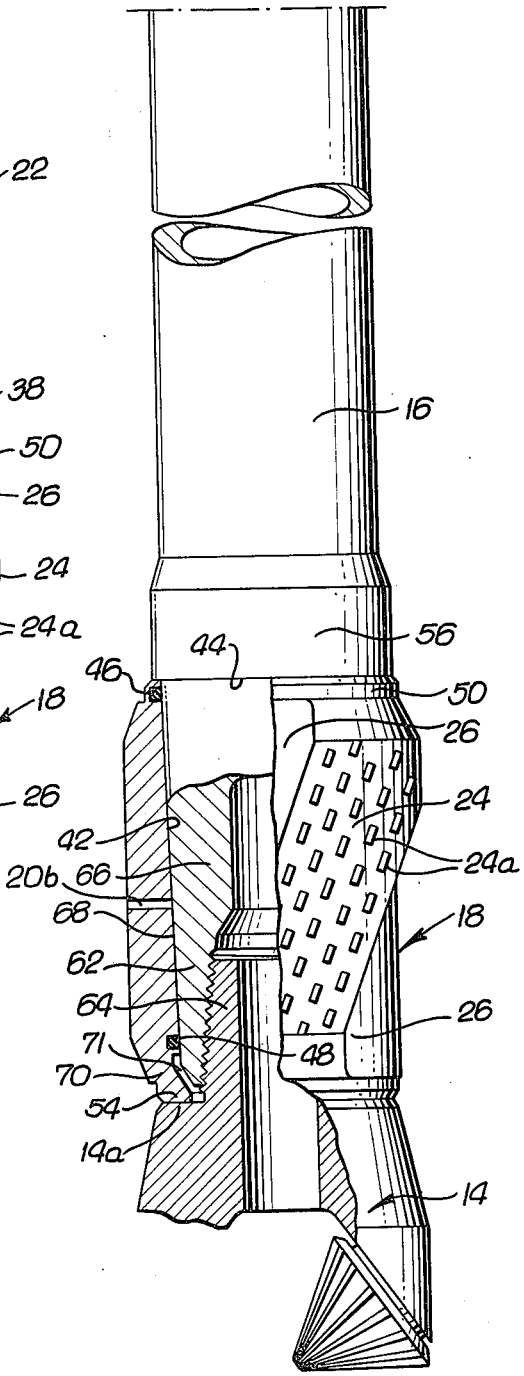

Referring to the drawings:

FIG. 1 is a side elevational view of the lower portion of a rotary drill string with stabilizers mounted thereon; and FIGS. 2*a* and 2*b* together constitute a longitudinal section, partly disclosed in elevation, of upper and lower stabilizers mounted on the body structure portions of the drill string, taken along the line 2—2 on FIG. 1, FIG. 2*b* being a lower continuation of FIG. 2*a*.

As disclosed in the drawings, a lower portion 10 of a rotary drill string 11 is positioned in a bore hole 12. A drill bit 14 for drilling the hole is threaded into the lower end of the lowermost drill collar portion 16, constituting the lower end of the drill string, with the bit body shoulder 14*a* bearing against the lower end of a lower stabilizer sleeve 18. The drilling weight on the drill bit is provided mainly by the string of drill collars 16. The upper portion of the drill string 11 extends to the top of the hole 12, serving for transmission of torque to the bit and the feeding of drilling mud, or the like, to the bottom of the hole, for the purpose of cleaning the hole and drill bit carrying the cuttings upwardly through the annulus around the drill string.

By mounting stabilizers at intervals along the string of drill collars, and also at the lower end of the drill collar string just above the drill bit, centering of the drill collar string in the hole 12 is achieved. It will be noted that the greatest demands are made on the stabilizer 18 immediately above the drill bit 14, since after relatively little wear on the latter stabilizer, as compared to the stabilizers positioned at higher elevations along the drill string, undesired deflection of the hole may occur.

The stabilizer 18 disclosed in FIG. 2*a* is comprised of a sleeve 20 positioned on a body portion or sub 22 of the drill string, a plurality of external spiral ribs 24 being integral with the sleeve. Each stabilizer 18 has an effective diameter corresponding to the diameter of the hole to properly center the drill string and bit in the hole, the inclined ribs 24 overlapping each other to insure the ability of the ribs to collectively contact the wall of the hole around its full circumference. Drilling mud and cuttings can flow upwardly through the spiral passages 26 between the ribs 24. The external contact surfaces of the spiral ribs 24 are highly wear resistant, but should preferably have no cutting edges which would undesirably increase the diameter of the hole. Wear resistance is increased by suitably securing tungsten carbide members 24*a* in the outer portions of the ribs, in a known manner.

The upper end of the body portion 22 is constituted as a conical threaded box (not shown) for connection with a corresponding threaded pin (not shown) of an adjacent drill collar section 16. The lower end of the body portion 22 has a conical threaded pin 30 for connection with a companion threaded box 31 of a drill collar section 16 therebelow.

Between the pin thread 30 and the cylindrical portion 38 of the body 22, the latter has a slightly tapered body or pin portion 40 providing a conical external surface corresponding to and adapted to receive a mating internal or inner conical surface 42 of the stabilizer sleeve 20. The conical body member 40 is of a reduced diameter with respect to the diameter of the cylindrical portion 38 of the body portion 22, providing a transverse shoulder 44 therebetween. The internal conical surface of the sleeve 20 of the stabilizer 18 is shrink-fitted onto the external mating conical surface of the body member 40, the internal surface 42 of the sleeve 20 being provided with circumferential grooves to receive internal spaced upper and lower elastomer seals 46 and 48 to aid in mounting the stabilizer 18 by a shrink-fit on the body member 40, as described below, and in maintaining the shrink-fitted stabilizer on the tapered body member 40. The angle of taper of the body member 40 and the internal surface of the stabilizer sleeve 20 can range from about ¼° to 4°; for example, about ½° for effective stabilizer application and retention.

When the stabilizer 18 is properly shrink-fitted on the body member 40, as described below, the upper end 50 of the sleeve 20 is in engagement with the shoulder 44 of the member 22, forming a metallic seal therebetween. Similarly, a metallic seal is provided by the upper shoulder 52 of the lower drill collar box 31 contacting the lower end 54 of the stabilizer sleeve 20 upon threading and tightening the box 31 on the pin 30. These metallic seals prevent the drilling mud from entering the interior of the sleeve 20 and contaminating the tapered coengaging surfaces on the sleeve and body member 40.

In FIG. 2*b*, a body member or sub 56 is threadedly connected by an upper box thread (not shown) to a pin (not shown) of a lower drill collar section 16. The lower end portion of the body member of sub 56 has a threaded box 62 for threaded engagement with the usual upper pin 64 forming the upper portion of the drill bit 14. In this embodiment, the sub 56 has a lower portion 66 of reduced diameter having a conical outer surface 68 which tapers downwardly.

A stabilizer 18 having a conical or tapered internal surface corresponding to the surface 42 of FIG. 2*a* is shrink-fitted onto the conical lower end portion 66 of the sub 56, with the upper end 50 of the stabilizer in engagement with the shoulder 44 on the sub 56, the lower end 54 of the stabilizer being engaged by the drill bit shoulder 14*a*.

The method and apparatus for mounting each stabilizer sleeve on its companion body structure is illustrated and described in the above U.S. Pat. No. 3,945,446, and need not be repeated in detail. The stabilizer sleeves may both be mounted on their companion body structures in the same manner. Each of the tapered end portions 40 or 66 can first be cleaned. The coefficient of friction between the internal sleeve surface and the external tapered surface may be increased by applying to the surfaces a coating of an abrasive material, which can be tungsten carbide powder of 200 mesh size suspended in a light oil. The stabilizer sleeve 18 is then pushed on the tapered end portion 40 or 66 until the upper and lower seals 46 and 48 are both engaged with the external pin surface of the pins 40 or 66, at which time there is a longitudinal space between the upper end of each sleeve and its companion shoulder 44. Hydraulic fluid under high pressure is then supplied through a suitable port 20b to the space between the sleeve and the pin member 40 or 66 on which it is mounted to expand the sleeve hydraulically while the sleeve is being forced, in a suitable manner, longitudinally upwardly along the companion tapered pin 40 or 66, until the upper end of the sleeve is caused to bear against the companion shoulder 44 on the body member. The hydraulic pressure is then relieved, which permits the stabilizer sleeve 20 or 42 to contract, its inner surface frictionally engaging the externally tapered surface of the pin 40 or 66 with great force. Upon releasing of the hydraulic pressure, a large hoop stress remains in the stabilizer sleeve 20, which can, for example, be about 7,000 psi or more, insuring a powerful gripping force between the sleeve and pin.

The stabilizer sleeve 18 can be disassembled, after it has become worn, by applying hydraulic pressure through the port 20b into the sleeve and by shifting the sleeve downwardly away from the shoulder 44. Because of the conical taper between the pin and sleeve, the application of hydraulic pressure itself effects exertion of a longitudinal force on the sleeve to shift it downwardly away from the shoulder 44 and release it from frictional engagement from the tapered pin 40 or 66, permitting the sleeve to be readily removed.

In connection with the stabilizer sleeve 18 mounted on the drill string closely adjacent the drill bit 14, swelling of the threaded box 62 has occurred where the lower end of the collar box is not sufficiently thick in the radial direction in the plane of contact between the box and the drill bit shoulder 14a, as disclosed in the prior U.S. Pat. No. 3,945,446. Such swelling created interference with the stabilizer sleeve 18 and interferes with its subsequent removal from the tapered pin 66, inasmuch as the sleeve cannot be shifted longitudinally downwardly away from its shoulder 44. When the sleeve has been dismounted, it is often found to be damaged, which is also true of the threaded box 62.

Not only is difficulty encountered in dismounting the sleeve, but the mounting of a replacement sleeve is also interfered with because of the box swelling.

The above difficulties are overcome with the arrangement disclosed in the drawings. As shown in FIG.

2*b*, the lower end 70 of the stabilizer sleeve 18 is internally upset, extending inwardly partially under the lower end of the box 62. The internally upset portion is also provided with relief 71 and is spaced from the lower end of the box by a small amount when the upper end of the sleeve engages the body shoulder 44. When the drill bit is threadedly connected to the box 62 and is made up tightly in the box, the extent of tightness between the threads is limited by engagement of the bit shoulder 14*a* with the lower internally upset end 54 of the stabilizer sleeve. The longitudinal force is transmitted from the bit through the stabilizer sleeve 18 itself and to the body shoulder 44, none of such longitudinal force being exerted against the end of the box 62, which could otherwise cause its deformation. Because of the internal upset 70, the lower end of the sleeve has a greater annular bearing area of contact with the bit shoulder 14*a*, thereby causing the transmission of the longitudinal force through the sleeve to the body shoulder 44 without any substantial inward deformation of the internally upset portion 70. Whatever deformation that might occur merely results in a slight closing of the relief or space 71 between the internally upset portion 70 and the lower end portion of the box 62.

The net result is that plastic deformation of the box 62 is so small as to be negligible, even with small radial thicknesses of the lower end of the box 62. Insufficient deformation of the parts occurs so that there is no interference between the sleeve 18 and the box 62, which has heretofore precluded removal of the stabilizer sleeve from the tapered pin 66 and replacement of the stabilizer sleeve by another stabilizer sleeve.

With the upper stabilizer sleeve 18 located in the position illustrated in FIG. 2*a*, the same condition prevails. The internal upsetting of the lower portion of the sleeve provides a large annular area of contact between the threaded box shoulder 52 and the lower end 54 of the stabilizer sleeve. Any tendency for the stabilizer sleeve to be deformed by the make-up torque between the drill collar box 31 and the pin 30, which might cause serious inordinately high gripping of the sleeve against the tapered pin 40, is avoided. If the internally upset portion 70 were to deform, it would merely move radially inwardly to a slight extent towards the pin surface 40 which it surrounds. However, in view of the initial relief or clearance 71 provided between the internally upset portion and the pin 40, such radial deformation of the internally upset portion would not cause any engagement or interference with the pin 40, and would, therefore, not preclude ready removal of the sleeve from the pin 40 and the ready replacement of another sleeve on the pin.

I claim:

1. A rotary drill string stabilizer apparatus for use in rotary drilling of a bore hole; comprising a body structure having first connecting means adapted to secure such structure in a tubular running string, said body structure including a body member having a conical outer surface and a passage therethrough through which drilling fluid from the tubular running string can flow, a stabilizer comprising a stabilizer sleeve having a conical inner surface matching the conical configuration of said conical outer surface of said body member, said stabilizer sleeve being mounted on said body member with said conical outer and inner surfaces in friction contact, longitudinally spaced peripheral seals preventing fluid leakage between said inner and outer surfaces from the region between said seals, means for conducting fluid under pressure to the region between said conical inner surface and conical outer surface and between said seals to expand said sleeve and enable said sleeve to be moved relatively longitudinally along said conical outer surface to shrink-fit said sleeve on said body member upon relieving of the fluid pressure, said sleeve having a projecting portion at the small diameter end of said conical inner surface extending laterally inwardly toward the axis of said body member, said body member having second connecting means at the small diameter end of said conical outer surface, a companion member secured to said second connecting means and bearing against said projecting portion to exert a compressive force thereon urging said sleeve in a direction toward the large diameter end of said conical outer surface, the co-engaging bearing surfaces of said projecting portion and said companion member being of substantial radial extent and disposed substantial normal to the axis of said body member, stabilizer sleeve, and companion member.

2. Apparatus as defined in claim 1; said body member having a shoulder adjacent the large diameter end of said conical outer surface, one end portion of said stabilizer sleeve abutting said shoulder, said companion member urging said sleeve in a direction toward said shoulder.

3. Apparatus as defined in claim 1; said second connecting means comprising a thread, said companion member having a thread meshing with said other thread to secure said companion member to said second connecting means.

4. Apparatus as defined in claim 1; said second connecting means comprising a box thread, said companion member having a pin thread meshing with said box thread to secure said companion member to said second connecting means.

5. Apparatus as defined in claim 1; said second connecting means comprising a box thread, said companion member being a drill bit having a pin thread meshing with said box thread, said drill bit having a shoulder bearing against said projecting portion.

6. Apparatus as defined in claim 1; said body member having a shoulder adjacent the large diameter end of said conical outer surface, one end portion of said stabilizer sleeve abutting said shoulder, said companion member urging said sleeve in a direction toward said shoulder; said second connecting means comprising a box thread to secure said companion member in said second connecting means.

7. Apparatus as defined in claim 1; said body member having an upper shoulder above and adjacent the large diameter end of said conical outer surface, the upper end portion of said stabilizer sleeve abutting said shoulder, said second connecting means comprising a box thread, said companion member being a drill bit having a pin thread meshing with said box thread, said drill bit having a shoulder bearing against said projecting portion to urge said sleeve in a direction toward said shoulder.

8. A rotary drill string stabilizer apparatus for use in rotary drilling of a bore hole; comprising a body structure having first connecting means adapted to secure such structure in a tubular running string, said body structure including a body member having a conical outer surface and a passage therethrough through which drilling fluid from the tubular running string can flow, a stabilizer comprising a stabilizer sleeve having a conical inner surface matching the conical configuration of said conical outer surface of said body member, said stabilizer sleeve being mounted on said body member with said conical outer and inner surfaces in friction contact, longitudinally spaced peripheral seals preventing fluid leakage between said inner and outer surfaces from the region between said seals, means for conducting fluid under pressure to the region between said conical inner surface and conical outer surface and between said seals to expand said sleeve and enable said sleeve to be moved relatively longitudinally along said conical outer surface to shrink-fit said sleeve on said body member upon relieving of the fluid pressure, said sleeve having a projecting portion at the small diameter end of said conical inner surface extending laterally inwardly toward the axis of said body member, said body member having second connecting means at the small diameter end of said conical outer surface, and a companion member secured to said second connecting means and bearing against said projecting portion to exert a compressive force thereon urging said sleeve in a direction toward the large diameter end of said conical outer surface; said inwardly projecting portion extending inwardly to a smaller diameter than the small diameter of said conical outer surface.

9. Apparatus as defined in claim 8; said inwardly projecting portion being spaced from said body member to be free from contact therewith.

10. Apparatus as defined in claim 8; said inwardly projecting portion underlying the small diameter end of said conical outer surface.

11. Apparatus as defined in claim 10; said inwardly projecting portion being spaced from said body member to be free from contact therewith.

12. A rotary drill string stabilizer apparatus for use in rotary drilling of a bore hole; comprising a body structure having first connecting means adapted to secure such structure in a tubular running string, said body structure including a body member having a conical outer surface and a passage therethrough through which drilling fluid from the tubular running string can flow, a stabilizer comprising a stabilizer sleeve having a conical inner surface matching the conical configuration of said conical outer surface of said body member, said stabilizer sleeve being mounted on said body member with said conical outer and inner surfaces in friction contact, longitudinally spaced peripheral seals preventing fluid leakage between said inner and outer surfaces from the region between said seals, means for conducting fluid under pressure to the region between said conical inner surface and between said seals to expand said sleeve and enable said sleeve to be moved relatively longitudinally along said conical surface to shrink-fit said sleeve on said body member upon relieving of the fluid pressure, said sleeve having a projecting portion at the small diameter end of said conical inner surface extending laterally inwardly toward the axis of said body member, said body member having second connecting means at the small diameter end of said conical outer surface, and a companion member secured to said second connecting means and bearing against said projecting portion to exert a compressive force thereon urging said sleeve in a direction toward the large diameter end of said conical outer surface; said body member having a shoulder adjacent the large diameter end of said conical outer surface, one end portion of said stabilizer sleeve abutting said shoulder, said companion member urging said sleeve in a direction toward said shoulder; said inwardly projecting portion extending inwardly to a smaller diameter than the small diameter of said conical outer surface.

13. Apparatus as defined in claim 12; said inwardly projecting portion being spaced from said body member to be free from contact therewith.

14. Apparatus as defined in claim 12; said companion member urging said sleeve in a direction toward said shoulder; said inwardly projecting portion underlying the small diameter end of said conical outer surface.

15. Apparatus as defined in claim 14; said inwardly projecting portion being spaced from said body member to be free from contact therewith.

16. A rotary drill string stabilizer apparatus for use in rotary drilling of a bore hole; comprising a body structure having first connecting means adapted to secure such structure in a tubular running string, said body structure including a body member having a conical outer surface and a passage therethrough through which drilling fluid from the tubular running string can flow, a stabilizer comprising a stabilizer sleeve having a conical inner surface matching the conical configuration of said conical outer surface of said body member, said stabilizer sleeve being mounted on said body member with said conical outer and inner surfaces in friction contact, longitudinally spaced peripheral seals preventing fluid leakage between said inner and outer surfaces from the region between said seals, means for conducting fluid under pressure to the region between said conical inner surface and between said seals to expand said sleeve and enable said sleeve to be moved relatively longitudinally along said conical surface to shrink-fit said sleeve on said body member upon relieving of the fluid pressure, said sleeve having a projecting portion at the small diameter end of said conical inner surface extending laterally inwardly toward the axis of said body member, said body member having second connecting means at the small diameter end of said conical outer surface, and a companion member secured to said second connecting means and bearing against said projecting portion to exert a compressive force thereon urging said sleeve in a direction toward the large diameter end of said conical outer surface; said body member having an upper shoulder above and adjacent the large diameter end of said conical outer surface, the upper end portion of said stabilizer sleeve abutting said shoulder, said second connecting means comprising a box thread, said companion member being a drill bit having a pin thread meshing with said box thread, said drill bit having a shoulder bearing against said projecting portion to urge said sleeve in a direction toward said shoulder; said inwardly projecting portion underlying the small diameter end of said conical outer surface and extending inwardly to a smaller diameter than the small diameter of said conical outer surface, said inwardly direction portion being spaced from said body member to be free from contact therewith.

* * * * *